US009706318B2

(12) United States Patent
Sø et al.

(10) Patent No.: US 9,706,318 B2
(45) Date of Patent: Jul. 11, 2017

(54) ANTENNA UNIT

(71) Applicant: Oticon A/S, Smørum (DK)

(72) Inventors: Rune Sø, Smørum (DK); Jens Troelsen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 14/976,984

(22) Filed: Dec. 21, 2015

(65) Prior Publication Data

US 2016/0183015 A1 Jun. 23, 2016

(30) Foreign Application Priority Data

Dec. 22, 2014 (EP) ..... 14199692

(51) Int. Cl.
*H04R 25/00* (2006.01)

(52) U.S. Cl.
CPC ..... *H04R 25/60* (2013.01); *H04R 25/554* (2013.01); *H04R 25/65* (2013.01); *H04R 2225/51* (2013.01)

(58) Field of Classification Search
CPC .... H04R 25/65; H04R 25/552; H04R 25/554; H04R 2225/51; H04R 2499/01; H02Q 1/273
USPC ..... 381/312, 315, 322, 323, 324, 328, 330, 381/331; 455/90.3, 575.1, 575.7
See application file for complete search history.

(56) References Cited

U.S. PATENT DOCUMENTS

| | | | | |
|---|---|---|---|---|
| 8,699,733 | B2 * | 4/2014 | Polinske | H01Q 1/243 381/322 |
| 2010/0156728 | A1 | 6/2010 | Alvey et al. | |
| 2013/0343586 | A1 | 12/2013 | Kvist et al. | |
| 2014/0010393 | A1 * | 1/2014 | Kvist | H01Q 9/24 381/315 |
| 2014/0010394 | A1 | 1/2014 | Kvist | |

FOREIGN PATENT DOCUMENTS

| | | |
|---|---|---|
| EP | 1 681 903 A2 | 7/2006 |
| EP | 1 681 903 A3 | 7/2006 |

* cited by examiner

*Primary Examiner* — Brian Ensey
(74) *Attorney, Agent, or Firm* — Birch, Stewart, Kolasch & Birch, LLP

(57) ABSTRACT

The present disclosure relates to a hearing instrument including a housing to be worn at an ear of a person. The hearing instrument including an antenna unit having a slot. Further, the antenna unit comprises a loading wing arranged so as to focus the nearfield of the inside the hearing instrument.

20 Claims, 3 Drawing Sheets

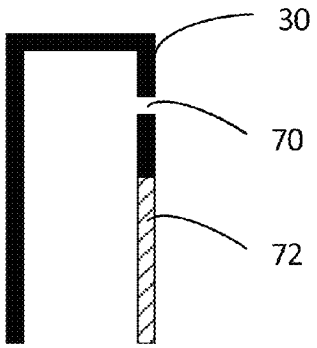
Fig. 10
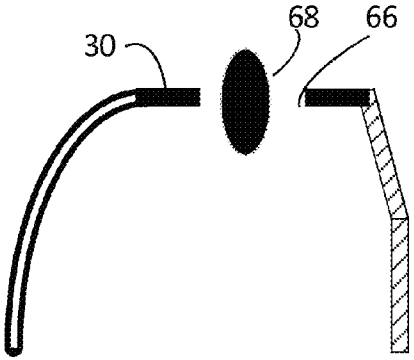
Fig. 11
Fig. 12
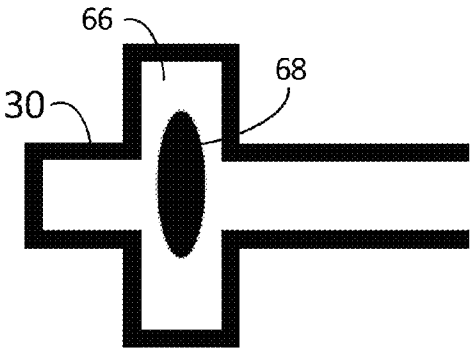
Fig. 13
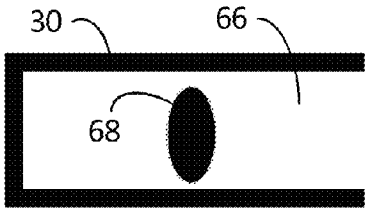
Fig. 14
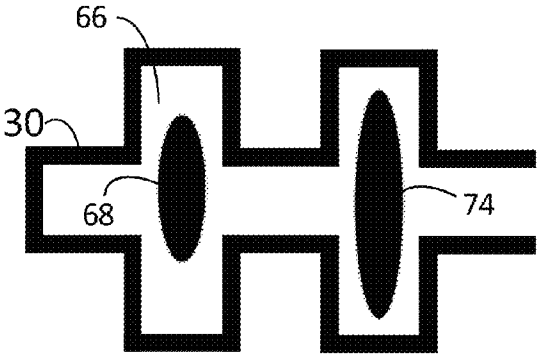
Fig. 15

ANTENNA UNIT

The present disclosure is concerned with antenna units. The present disclosure is further concerned with antenna units used in hearing instruments.

Devices placed at the ear for e.g. assisting a person having a hearing loss, or for any other reason providing an enhanced listening experience, may advantageously receive and/or transmit signals to other units wirelessly. For establishing wireless communication, an antenna is needed.

It is an intension that the hearing instruments described in the present disclosure may provide improved wireless communication. Further, the present disclosure may provide an alternative solution compared to prior art.

Generally, hearing instruments are not sold in versions only suitable for being used on either left or right ear only. When providing an antenna unit in a housing for a hearing instruments there is a challenge in ensuring that antenna performance is the same regardless of the housing being placed at the left or right ear. Further, the resonant frequency of an antenna unit is not the same when the antenna unit is placed near a head as when it is placed substantially free from other objects.

In one aspect an antenna unit for use in a housing to be worn at an ear of a person may be embodied with one or more of the below mentioned features. The antenna unit may comprise antenna an electrically conductive material having a first surface with a slot, the antenna unit further comprises a loading wing. The placement of the loading wing relative to the electrically conductive material may be one of many, but should be so that the nearfield is focused inside the hearing instrument. The slot may be an open slot. The slot may be a quarter-wavelength slot, or at least an electrically seen quarter-wavelength slot.

In one aspect a hearing instrument may include a housing configured to be worn at an ear of a person, the housing comprising a top part and respective left and right sides, the hearing instrument including an antenna unit. The antenna unit may comprise an electrically conductive material having a first surface with a slot. The slot may be formed by a cut-out or other opening in the substrate of the electrically conductive material. The electrically conductive material may be arranged at, i.e. near such as parallel to, the top part of the housing. If the housing comprises bends, such as two or more parts constituting the top part, the antenna may comprise several parts connected so that the electrically conductive material is near each top part of the housing. The antenna unit may further comprise a first loading wing electrically connected to the first surface. The loading wing may be attached along the length of the loading wing. The loading wing may be arranged at an angle relative to the electrically conductive material at a right or left side of the housing. The angle is preferably not zero, i.e the two parts should not be parallel. The loading wing is arranged so that during use, e.g. during active transmission, the first loading wing focus the nearfield part of the emitted field inside the hearing instrument.

When the slot is fed by a signal, an electric field is created across the slot, whereby the emitted electric field has the main part of the electric field component in the direction across the slot. When the antenna unit is positioned in a housing behind the ear of a user, the emitted field will propagate along a surface of the head of the user with its electrical field substantially orthogonal to the surface of the head of the user.

Advantageously, the first loading wing may extends in a plane substantially orthogonal to the first surface. In addition to improved focus of the nearfield, this configuration also has the benefit of being ideal in a small hearing device that is to be positioned behind the pinna of a user.

The loading wing may be electrically connected to the first surface at multiple places, or continuously along substantially the length of the loading wing, such as the entire length or part of the length, e.g. in sections or in a single length. The relationship of the area of the loading wing to the area of the first surface may be in the range 1:10 to 10:1. The two or more loading wings may be attached to the first surface, so that a plurality of loading wings are attached. The presence of a loading wing is contemplated to enhance the performance of the antenna unit as it improves the bandwidth performance. Further to this, it has surprisingly been seen that the left-right performance is improved, this means that e.g. a hearing instrument having an antenna unit and the hearing instrument is configured to be placed at either side of the head. The presence of the loading wing improves the bandwidth of the antenna unit. In addition to one, two or more loading wings, a parasitic element may be attached to the antenna unit.

The antenna unit may be adapted to emit and/or receive electromagnetic signals at radio frequencies. Preferably the antenna unit is configured to operate in the ISM band. Especially radio frequencies may be in the range from 50 MHz to 15 GHz, such as 150 MHz to 750 MHz, such as 1 to 6 GHz, such as around 2.4 GHz, such as around 5 GHz.

The antenna unit may be configured for use in more than one frequency band or frequency. This could be useful if one frequency or frequency band is used for communication with a similar antenna unit placed at an opposite ear of a person, and a second frequency or frequency band is used for communication with an external device placed further away, e.g. a mobile phone or intermediate device or device placed at e.g. a television, this would eliminate the need for having two antenna units.

Further, a second loading wing may extend from the first surface at a right or left side of the housing opposite the first loading wing, so that the two loading wings extend in respective parallel planes or in the alternative the dihedral angle between the two loading wings is non-zero. Still further, multiple loading wings may be attached to the first surface.

Generally, a better antenna performance allow a lower power consumption of both the transmitter and receiver for a given link performance. The antenna unit according to the present disclosure may be used for wireless hearing instruments in which information is wirelessly communicated between a wireless accessory device and a hearing instrument. Portable, and wearable, units usually have limited operation time limited by the amount of power available from small batteries, and thus lowering power consumption to extend battery life is a major issue for such devices.

In one aspect an antenna unit as described herein may be used in a hearing instrument. The hearing instrument may comprise an audio converter for reception of an acoustic signal and conversion of the received acoustic signal into a corresponding electrical audio signal. The hearing instrument may comprise a signal processor for processing the electrical audio signal into a processed audio signal so as to compensate a hearing loss of a user of the hearing instrument. The hearing instrument may comprise a transducer connected to an output of the signal processor for converting the processed audio signal into an output signal. The hearing instrument may comprise a transceiver for wireless data communication, wherein the transceiver is connected to the antenna unit which is adapted for electromagnetic field emission and/or electromagnetic field reception. These components in the hearing instrument may be exchanged or supplemented with other components, devices and/or units having one or more additional functions.

DESCRIPTION OF THE DRAWINGS

The present disclosure has more details which are discussed in relation to the drawings in which:

FIGS. 10-12 are schematic illustrations of cross-sections of antenna devices, FIGS. 13-15 are schematic illustrations of openings or slots in antenna devices.

Figure 1:
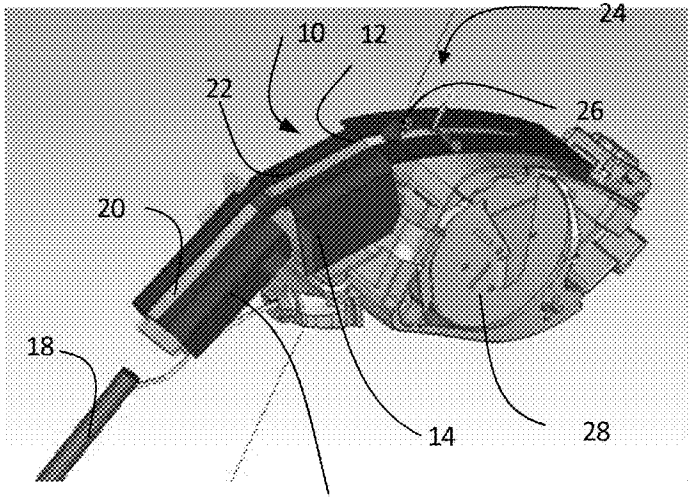
FIG. 1 is a schematic illustration of an antenna device mounted relative to various components.

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

FIG. 1 schematically illustrates an antenna unit 10 mounted on various components making up at least part of the sound processing part of a hearing instrument. At approximately the middle of the top of the antenna unit 10 a slot 12 is formed by the opening. At the side of the antenna unit 10 a loading wing 14 is formed. Here two loading wings are illustrated, namely the larger loading wing 14 and a smaller wing 16. Although not seen here, corresponding loading wings are positioned at the distal side. Antenna units may be constructed with a single loading wing, two loading wings, three loading wings, four loading wings, or even more loading wings.

It has been discovered that at least one loading wing will help tune the antenna unit to a desired operating frequency and/or desired bandwidth. Especially when operating in the GHz region, such as around 2.4 GHz and/or around 5 GHz, which fall within the ISM band utilized by various communication protocols, e.g. Bluetooth and Bluetooth Low Energy.

Antennas for transmission of RF electromagnetic signals are preferably designed to have an electrical size of at least one quarter of the wavelength of the transmitted signal, since this generally allows high antenna efficiency and wide bandwidth. However, many apparatuses do not have room for an antenna large enough to satisfy this condition. For an RF signal with a frequency of e.g. 100 MHz, one quarter of the wavelength equals 0.75 m. It is thus common to utilize antennas that are physically considerably smaller than one quarter of the wavelength. Such antennas are generally referred to as "electrically short" or "electrically small" antennas. The antenna units described herein are preferably such electrically short antennas.

The hearing instrument outlined in FIG. 1 is a BTE-type, meaning that the components shown is intended to be placed in a housing configured for being placed behind the pinna of a user. Further, this hearing instrument has a receiver-in-the-canal, meaning that a conductive lead 18 carries an electrical signal to a loudspeaker that is configured to be positioned in the ear canal of the user. The loudspeaker is often referred to as a receiver within the hearing aid industry.

The antenna unit 10 is composed of three major sections, where the section 20 is the left most section where the open end of the slot 12 is located. The antenna unit 10 is divided into three sections 20, 22, 24 for optimizing space use in the housing. Each section 20, 22, 24 of the antenna 10 is mechanically and electrically connected.

The assembly of antenna unit 10, 10' and the various components, in FIG. 1, is to be mounted in a housing to protect them from the surrounding environment and to provide a pleasing look to the user while providing wearing comfort.

Both antenna unit 10 and 10' comprises an electrically conductive material having a first surface with a slot 12. The antenna unit 10 further comprises a visible loading wing arranged relative to the electrically conductive material so as to focus the nearfield of the inside the hearing instrument. Various arrangements of the surface and loading wing are illustrated in cross-section in FIGS. 3-8, and 11-17.

The loading wing is characterized by being electrically connected to the first surface at multiple places, alternatively the loading wing may be electrically connected continuously along substantially the entire length of the loading wing, such as in sections or a single section. In contrast to a loading wing, a parasitic element is a conductive element, typically a metal rod, which is not electrically connected to anything else, and also the loading wing is not a ground plane, which is a conducting surface which is large in comparison to the wavelength and which is connected to the transmitter's ground.

The relationship of the area of the loading wing to the area of the first surface depends on the desired performance, it is presently preferred that the relationship between the area of the loading wing and the area of the first surface is in the range 1:10 to 10:1.

In some antenna units, two or more loading wings may be attached to the first surface. Generally, it has been found that the loading wing enhances the performance of the antenna unit, also when used in a system of two devices placed one at each ear of the user, where the devices needs to transfer information from one side of the head to the other, but also generally by tuning the antenna unit to the desired frequency band where the intended use for a device of this size falls in the GHz range.

It is presently preferred that the housing for the antenna unit 10, 10' is of the type placed behind the ear. Such a housing may include a speaker, which is sometimes referred to as a receiver, placed in the housing, this configuration is often called behind-the-ear, or in a device to be placed in or at the ear canal, this configuration is often called a receiver-in-the-ear. Such a housing is envisioned for the antenna unit 10 of FIG. 1, as the lead 18 is connected to a loudspeaker.

In further instances, the housing may be connected to an implant, such as a cochlear implant, where sound is received by an input transducer in the housing and converted to a digital signal, which is then processed and/or transmitted to the implant. Further, the housing may be connected to a bone-anchored device, where received sound is converted into vibrations transmitted via the bone in the skull to the inner ear.

The dihedral angle of the loading wing 14, 16 plane and the first surface may be in the range 0 to 180 degrees, such as in the range 10 to 160 degrees, such as in the range 20 to 140 degrees, such as in the range 30 to 120 degrees, such as in the range 40 to 100 degrees, such as 50 to 95 degrees, such as 60 to 90 degrees, such as 70 to 80 degrees, such as around 90 degrees.

The loading wing 14, 16 may have an overall geometry corresponding to an oblong, square or any polygonal geometry. Further, the loading wing 14, 16 may be composed of a single section or two or even more electrically connected sections. In FIG. 1 the loading wing comprises two sections 14 and 16 shown on one side of the antenna unit 10.

Illustrated in FIG. 1, the loading wing 14, 16 extends in a plane substantially orthogonal to the first surface to which the respective loading wing 14 or 16 is connected. Preferably, when the antenna unit 10, 10' is arranged in the housing, the first surface is arranged at the top part of the housing and the loading wing 14, 16 extends along a sidewall of the housing. This provides a well performing antenna unit 10, 10' and further minimize the difference in performance depending on whether the housing is placed at the left of right ear of the user. Normally, hearing instruments are formed so that they may be used at either side of the head, i.e. without requiring the housing to be worn on a specific ear-side. In case a loading wing is composed of two or more sections, the loading wing may comprise one or more bends, e.g. at the intersection of the two sections forming the loading wing, such as illustrated in FIG. 10 and FIG. 11.

Generally, the antenna unit 10, 10' with the slot 12 forms a resonant structure when the antenna is loaded by the presence of a head or even in free space. The resonant frequency of the antenna is preferably in the range 50 MHz to 10 GHz, such as in the ISM band, such as around 2.4 GHz, such as around 5 GHz. This may be advantageous when dealing with the Bluetooth communication protocol. Designing the antenna unit for other suitable frequencies or frequency intervals is also possible.

The first surface has a plane surface, as this is the most easy to arrange in a housing to be worn at an ear of a person and these flat shapes are also easy to manufacture. Alternatively, the first surface may include one or more protrusions, either smooth or discontinuous, which may for instance fit into a recess in the housing, this is for instance illustrated in FIG. 6 and FIG. 7. The first surface is preferably provided as a sheet or coating on a substrate. In the antenna unit, or at least when arranged in a housing, the first surface and the loading wing are arranged so that they do not coincide, this means that the first surface and the loading wing either are displaced relative to each other, or that an angle between them, e.g. between the surface normal of the first surface and the surface normal of the loading wing, wherein the angle is different from zero. Preferably, these planes are flat, or substantially flat, meaning that any three points not in a line on the electrically conductive material could be used to define or characterize the plane.

Figure 2:
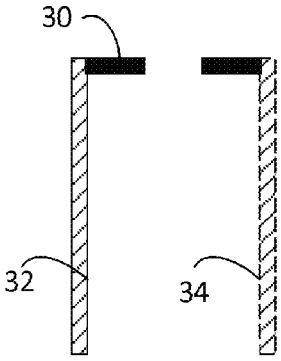

The antenna units 10 and 10' of FIGS. 1 and 2 are contemplated to improve wireless communication, i.e. ensure the best transfer of signals between two devices by improving bandwidth and/or signal to noise ratio for the transmission. The same applies to the other arrangements illustrated in the remaining figures.

The antenna units 10, 10' and 10" may be used at a desired frequency, and for use with e.g. the Bluetooth or Bluetooth low energy standard, where the operational frequency is around 2.4 GHz or 5 GHz. The same applies to the other arrangements illustrated in the figures.

As schematically illustrated in FIG. 2, an antenna unit 10" may comprise more than one loading wing. Here two loading wings 32 and 34, indicated with the hatched pattern, extend in two planes substantially orthogonal to the first surface 30. As the illustrations herein are schematic, the widths and lengths are not to scale.

The first surface 30 with the slot is to be arranged at a top part of the housing, while the two loading wings 32 and 34 extends along, or In the same direction as, the sidewalls of the housing, thereby leaving as much space inside the housing for other components as possible. The shape of the loading wings 32, 34 need not be identical, nor does the size of them, but in some instances, they may be substantially similar. The loading wing may extend in a plane, which mathematically considered is flat, and extending in two-dimensions, but may alternatively define a shaped surface, e.g. have a cross-section that is non-linear.

FIGS. 3-6 schematically illustrates different arrangements where two loading wings 32, 34 are attached to a structure, indicated by the first surface 30 having a slot.

In FIG. 2, one loading wing 32 extends substantially orthogonal to the surface 30 having the slot. An optional loading wing 34 is illustrated with punctured lines at the right-hand side. If both loading wings 32 and 34 are present the two loading wings 32, 34 are arranged parallel to each other. Such a configuration could e.g. provide the first surface with the slot at the surface 30 at a top part of the housing, while the two loading wings 32, 34 extends along, or at least in the same direction as, the sidewalls of the housing, thereby leaving space inside the housing, between the loading wings 32, 24, for other components, e.g. in a housing with flat side surfaces.

Figure 7:
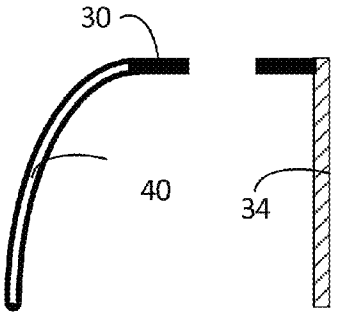
Figure 6:
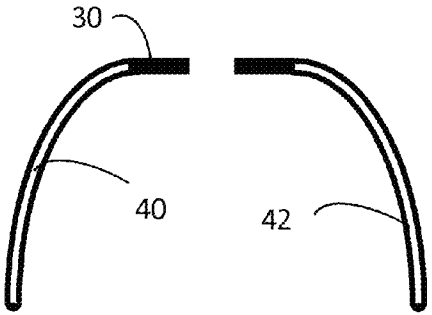

Generally, the shape of the loading wings 32, 34 need not be identical, nor does the size of them, while in some instances, they may be substantially similar, such as illustrated in FIG. 2. The loading wing 32 may extend in a plane, which may be described as flat, and extending in two-dimensions, but may alternatively define a shaped surface, e.g. have a cross-section that is non-linear, such as illustrated in FIG. 6 and FIG. 7. Similar applies to loading wing 34.

Figure 4:
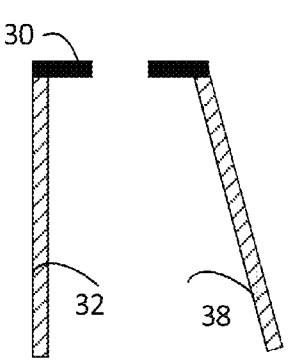
FIGS. 2-7 are schematic illustrations of cross-sections of antenna devices.
Figure 3:
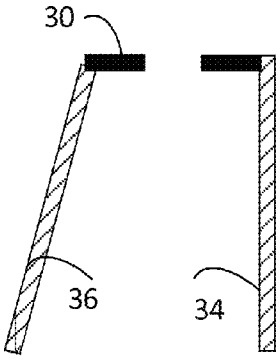

In FIG. 3, one loading wing 34 extends substantially orthogonal to the surface 30 having the slot while the other loading wing 32 extends at an angle relative to the surface. FIG. 4 schematically illustrates the opposite situation, i.e. a slanted loading wing 38 and an orthogonal loading wing 32. Either, one or both loading wings may have an angle relative to the first surface 30. As an example, a first loading wing extend substantially orthogonal to the first surface, whereas the other loading wing extend at an angle different from orthogonal, e.g. 10, 20, 30, or 45 degrees, or any other suitable angle.

Figure 5:
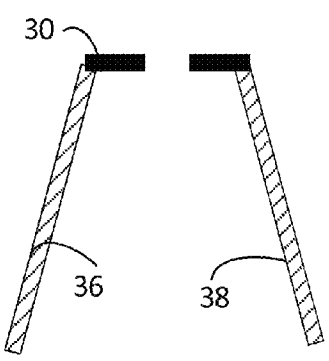

In FIG. 5, both loading wing 36 and 38 extends at an angle relative to the surface 30, here it is illustrated that the angle is the same for both loading wings 36, 38, however, these angles may be different for the individual surfaces. The two loading wings 36, 38 may have an angle different from zero in one, two, or three dimensions relative to each other. The angle may be measured or determined relative to a free end of the loading wing 36, 38.

Further, each loading wing 36, 38 may be constructed from multiple pieces allowing parts of the loading wing to extend at specific angles at specific sections, not illustrated here.

FIG. 6 schematically illustrates an arrangement where each of two loading wings 40, 42 are not flat, i.e. have a curved cross-section, here illustrated as extending away from center of the structure providing a larger interior space. This could be advantageous in situations where the housing in which the antenna unit 10, 10' is to be placed does not have flat side walls.

FIG. 7 illustrates an arrangement where one of the loading wings 34 is substantially flat and the other 40 is curved.

Figure 8:
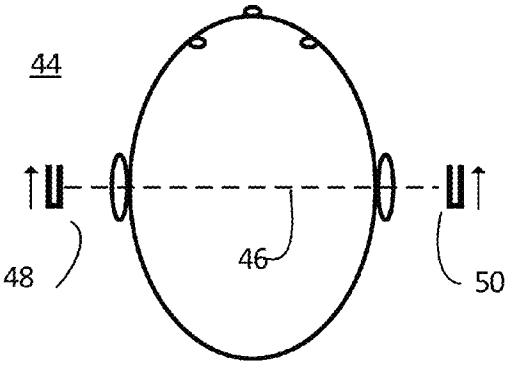
FIG. 8 is a schematic illustration of a top-down view of the head of a wearer and two hearing instruments.

FIG. 8 schematically illustrates a head 44 of a user seen from above. The ears define an ear-to-ear axis, indicated by the punctured line 46. When the user wish to wear a hearing instrument an antenna unit 10, 10', the antenna unit 10, 10' may then be arranged in the hearing instrument so that a length-wise axis of the slot extends substantially orthogonal to the ear-to-ear axis of the users head. The two hearing Instruments are indicated by 48 and 50 illustrating one possible orientation of the slot in the respective hearing instrument 48, 50.

Preferably, when the hearing instrument 48, 50 with the antenna unit 10, 10', is worn at the ear, and the intended use of the antenna unit 10, 10' is to transfer and receive a signal to/from a similar hearing instrument placed at the opposite ear, it is advantageous that the length-wise axis of the slot extends orthogonal or substantially orthogonal to the ear-to-ear axis 46 of the users head.

A slot plane could be defined by the outline of the slot, and the slot plane could be arranged so that the normal to the slot plane is perpendicular or parallel to the ear-to-ear axis 46, or even any other angle. In real use, the slot plane will most likely not be perfectly aligned with the ear-to-ear axis 46, and some deviation will occur. The theoretical angle could range from perpendicular to parallel, and take any value between them, or adjacent. The dihedral angle between the slot plan and an ear plane defined at the head of the person wearing the housing could be zero, substantially zero, or different from zero, depending on the intended use of the antenna. The ear plane defined at the head of the person would be perpendicular to the ear-to-ear axis 28.

Figure 9:
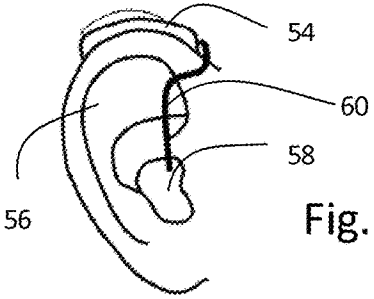
FIG. 9 is a schematic illustration of a hearing instrument having one part mounted behind an ear and a second part mounted at the ear canal opening.

FIG. 9 is a schematic view of a hearing instrument 52 of the BTE/RITE type, where a BTE-housing 54 is positioned behind the pinna 56. A receiver 58, here housing with a loudspeaker, is positioned at the opening of the outer ear canal. The receiver 58 is embedded in an ear mould. The BTE-housing 54 and the receiver 58 are connected by a coupling element 60. In the coupling element 60 two electric conductive leads connect to the receiver for providing an electrical signal to be transformed by the receiver to an acoustic output signal perceivable as sound by the user.

In FIG. 10 the electrically conductive material is be provided on a surface of a flex circuit board 62 including a bend 64. In some instances, this bend 64 could have a bend-axis substantially perpendicular to the ear-to-ear axis when the hearing instrument is worn by the user. This bend 64 enables further optimization of the space usage in the housing, which as stated earlier is of importance in small housings, as many users prefers housings for e.g. hearing instruments to be as unnoticeable and inconspicuous as possible. By including one or more bends, it is possible to adapt the antenna unit to allow arranging other, or all, components optimally inside the housing, and specifically inside the confines of the cavity formed by the antenna unit.

When the antenna unit is in use at a person's head, an electromagnetic field emitted by the antenna unit may propagate along a surface of the head of the user with its electrical field substantially orthogonal to the surface of the head of the user. This is contemplated to allow a signal to be transferred optimally, that is with lowest possible loss and thus highest possible bit rate, from the antenna unit to a receiving antenna unit at the opposite ear of the person.

As illustrated in FIGS. 12, 14, 15 and 16, a slot 66 may be suitably sized to receive a battery and/or an audio converter and/or an input device. Advantageously the slot of the antenna unit may have a size suitable for receiving components such as batteries or input devices such as push buttons, or even other electrical or mechanical components. This is contemplated to help save space in the housing, which is a major issue in e.g. hearing instruments. Further, components may be placed at various positions on the electrically conductive area.

In FIG. 11 a cross-sectional view of the slot 66 illustrate a component 68 arranged in the slot 66 so that part of the component 68 protrudes from the slot 66. Other configurations where the component 68 is flush with the first surface 30 may be contemplated. The component 68 may advantageously be a microphone or microphone system, e.g. a directional microphone system, or at least a part thereof. Further components may be present in the cavity or room formed by the antenna unit, e.g. signal processor, converters, matching circuits, battery etc. FIG. 14 schematically illustrates a top view of a slot 66 of a type where a, substantial, constant width of the slot 66 allow component 68 to be received therein.

In FIG. 12, a slot 70 is formed on one side of the antenna unit. A loading wing 72 is positioned at the same side as the slot 70. Here it is schematically shown that the first surface 30 with the slot 70 is in the same plane as the loading wing 72.

FIG. 13 schematically illustrates a slot 66 with one single enlarged area receiving the component 68. This could be useful when accommodating components with e.g. a larger diameter than the size of the slot 66. FIG. 15 schematically illustrates a slot 66 with two enlarged areas receiving two component 68 and 74.

Figure 16:
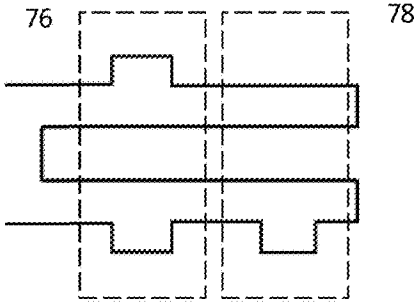
FIG. 16 is a schematic illustration of a slot divided into sections.

In the implementation such as illustrated in FIG. 16, the slot may be formed so as to accommodate or comprise two or even more areas having non-conductive surfaces forming a combined slot. The slot may be formed by a non-conductive area or openings or apertures in the substrate. Further, by providing more than one area, advantageous electromagnetic emission patterns may be established. When the slot includes multiple openings, these two or more opening may be used for receiving components, such as one or more microphones, microphone systems, buttons, switches, wheels, or combinations hereof. Owing to the structure of the housing and the intended position of a hearing instrument having the antenna unit, input devices, such as buttons and wheels, are most easily accessible by the wearer when placed at the top of the housing, i.e. the part facing away from the pinna when the hearing instrument is positioned at the intended position.

FIG. 16 is a schematic illustration of a slot for an antenna unit. The slot is divided into two sections, a first section 76 comprising part of the slot and two loading wings, located at opposite sides of the slot. Next to the first section 76 a second section 78 is located. The second section 78 comprises part of the slot and a single loading wing located at one side of the slot. In FIG. 16 only two sections are present, but multiple sections may be used for e.g. an antenna unit having multiple loading wings. This allows for designing an antenna unit having multiple loading wings, and possibly allowing the section to be angled relative to each other, e.g. as could be the case when positioning the antenna unit as in FIG. 1.

A feed connection 26 is provided to supply the antenna unit 10 with an electrical signal. The feed 26 is preferably a direct feed, but the feed may be a capacitive feed or other suitable feeding method. An antenna feed refers to the component or components of an antenna which feed radio waves to the rest of the antenna structure, or in receiving antennas collect the incoming radio waves, convert them to electric currents and transmit them to the receiver. For simplicity, neither feed nor transceiver is illustrated throughout the Figures.

The antenna unit as disclosed above may be used in a hearing instrument comprising an audio converter for reception of an acoustic signal and conversion of the received acoustic signal into a corresponding electrical audio signal, a signal processor for processing the electrical audio signal into a processed audio signal so as to compensate a hearing loss of a user of the hearing instrument, a transducer connected to an output of the signal processor for converting the processed audio signal into an output signal, and a transceiver for wireless data communication, wherein the transceiver is connected to the antenna unit adapted for electromagnetic field emission and/or electromagnetic field reception.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCE NUMERALS

Antenna unit 10, 10'
Slot 12
Larger Loading wing 14
Smaller loading wing 16
Conductive lead 18
Section 20, 22, 24
Feed 26
Battery 28
First surface 30
Loading wing 32, 34, 36, 38, 40, 42
Head 44
ear-to-ear axis 46
Hearing instruments 48, 50, 52
BTE housing 54
Pinna 56
Receiver 58
Coupling element 60
Flex circuit board 62
Bend 64
Slot 66
Component 68
Slot 70
Loading wing 72
Component 74
Section 76, 78

The invention claimed is:

1. A hearing instrument including a housing configured to be worn at an ear of a person, the housing comprising a top part and respective left and right sides, the hearing instrument including an antenna unit, the antenna unit comprising:

an electrically conductive material having a first surface, said first surface having a slot, where the electrically conductive material is arranged at the top part of the housing, the antenna unit further comprises a first loading wing electrically connected to the first surface along the length of the first loading wing and arranged at an angle relative to the electrically conductive material at a right or left side of the housing, so that during transmission the first loading wing focus the nearfield part of the emitted field inside the hearing instrument, wherein, along the length of said first loading wing, said first loading wing extends substantially continuously from said first surface to a peripheral edge of said first loading wing.

2. The hearing instrument according to claim 1, wherein the first loading wing extends in a plane substantially orthogonal to the first surface.

3. The hearing instrument according to claim 1, wherein a second loading wing extends from the first surface at a right or left side of the housing opposite the first loading wing, so that the first and second loading wings extend in respective parallel planes or in the alternative the dihedral angle between the first and second loading wings is non-zero.

4. The hearing instrument according to claim 1, wherein the first surface extends along the length of said housing, the first surface being divided into a plurality of sections, the slot extends along the length of said housing such that each of said plurality of sections includes a part of the slot, and at least one of said plurality of sections includes said first loading wing.

5. The hearing instrument according to claim 4, wherein the sections are arranged with an angle different from zero between the respective first surface parts of neighboring sections.

6. The hearing instrument according to claim 2, wherein the first and second loading wings extend in two planes, where one plane is substantially orthogonal to the first surface.

7. The hearing instrument according to claim 1, wherein when worn at the head of the person, a length-wise axis of the slot extends substantially perpendicular to the ear-to-ear axis of the users head.

8. The hearing instrument according to claim 1, wherein the electrically conductive material is provided on the surface of a flex circuit, the flex circuit including one or more bends having a respective bend-axis substantially perpendicular to the ear-to-ear axis when worn by the user.

9. The hearing instrument according to claim 1, wherein when in use at the persons head, an electromagnetic field emitted by the antenna propagates along a surface of a head of the user with its electrical field substantially orthogonal to the surface of the head of the user.

10. The hearing instrument according to claim 1, wherein the antenna with the slot forms a resonant structure when the antenna structure is loaded by the presence of a head or in free space.

11. The hearing instrument according to claim 1, wherein the slot comprises an opening configured to receive a battery and/or an audio converter and/or an input device.

12. The hearing instrument according to claim 1, wherein the slot comprises two or more areas having non-conductive surfaces forming a combined slot.

13. The hearing instrument according to claim 1, wherein the antenna is formed on one or more flex circuit boards and the slot is formed by one or more areas of electrically non-conductive material surrounded by electrically conductive material.

14. The hearing instrument according to claim 1, further comprising:

an audio converter for reception of an acoustic signal and conversion of the received acoustic signal into a corresponding electrical audio signal, a signal processor for processing the electrical audio signal into a processed audio signal so as to compensate a hearing loss of a user of the hearing instrument, a transducer connected to an output of the signal processor for converting the processed audio signal into an output signal, and a transceiver for wireless data communication, wherein the transceiver is connected to an antenna adapted for electromagnetic field emission and electromagnetic field reception.

15. The hearing instrument according to claim 14, wherein the hearing instrument is one of a completely-in-the-canal (CIC) hearing instrument, an in-the-ear (ITE) hearing instrument, a behind-the-ear (BTE) hearing instrument.

16. The hearing instrument according to claim 2, wherein the first surface comprises a plurality of sections each section comprising a part of the slot and at least one loading wing.

17. The hearing instrument according to claim 3, wherein the first surface comprises a plurality of sections each section comprising a part of the slot and at least one loading wing.

18. The hearing instrument according to claim 2, wherein when worn at the head of the person, a length-wise axis of the slot extends substantially perpendicular to the ear-to-ear axis of the users head.

19. The hearing instrument according to claim 3, wherein when worn at the head of the person, a length-wise axis of the slot extends substantially perpendicular to the ear-to-ear axis of the users head.

20. The hearing instrument according to claim 4, wherein when worn at the head of the person, a length-wise axis of the slot extends substantially perpendicular to the ear-to-ear axis of the users head.

* * * * *